US010632495B2

(12) United States Patent
Carey et al.

(10) Patent No.: US 10,632,495 B2
(45) Date of Patent: Apr. 28, 2020

(54) EXTENSION PAINT SPRAY-ROLLER SYSTEM

(71) Applicant: TriTech Industries, Inc., Union, NJ (US)

(72) Inventors: Danuta Carey, Stockholm, NJ (US); Daniel S. Hosley, Millsboro, DE (US); Christopher M. Walsh, Florham Park, NJ (US)

(73) Assignee: TriTech Industries, Inc., Union, NJ (US)

( * ) Notice: Subject to any disclaimer, the term of this patent is extended or adjusted under 35 U.S.C. 154(b) by 5 days.

(21) Appl. No.: 16/025,099

(22) Filed: Jul. 2, 2018

(65) Prior Publication Data

US 2020/0001321 A1 Jan. 2, 2020

(51) Int. Cl.

| | |
|---|---|
| ***B05C 17/035*** | (2006.01) |
| ***B05B 15/00*** | (2018.01) |
| ***B05C 17/02*** | (2006.01) |

(52) U.S. Cl.

CPC ..... *B05C 17/035* (2013.01); *B05B 15/00* (2013.01); *B05C 17/02* (2013.01); *B05C 17/0205* (2013.01)

(58) Field of Classification Search

CPC ..... B05B 15/60; B05B 15/63; B05B 15/65; B05B 15/652; B05B 15/654; B05B 15/658; B05B 15/68; B05B 15/628; B05C 11/025; B05C 17/0352; B05C 1/08; B05C 1/0804; B05C 1/0813; B05C 17/02; B05C 17/0205; B05C 17/022; B05C 17/0245; B05C 17/03; B05C 17/035

USPC ..... 239/532; 401/219

See application file for complete search history.

(56) References Cited

U.S. PATENT DOCUMENTS 1,268,709 A * 6/1918 Gill ..... B05B 15/652 239/532
1,653,907 A * 12/1927 Hilgerink ..... B05B 7/02 137/594
2,488,655 A * 11/1949 Bennett ..... B05C 17/035 401/15
2,845,647 A * 8/1958 Schemers ..... B05C 17/0205 15/145

(Continued)

FOREIGN PATENT DOCUMENTS

| | | | |
|---|---|---|---|
| JP | 2000-24576 | A | 1/2000 |
| KR | 10 2011 0102772 | A | 9/2011 |
| WO | 97/20638 | A1 | 6/1997 |

OTHER PUBLICATIONS

JetRoller for spray rolled application of architectural paints and coatings, Graco, 333428G, 6 pages, Aug. 2017.
British Search Report in GB1909535.5, dated Dec. 11, 2019.

*Primary Examiner* — Patrick M. Buechner
(74) *Attorney, Agent, or Firm* — Bucknam and Archer

(57) ABSTRACT

An extension paint spray-roller system includes a hydraulic paint spray extension system to which is mounted a paint roller system for use in combination. The hydraulic paint spray extension system includes an on-off control valve/handle communicating with a source of high pressure paint and connected via a straight-through swivel joint to a pole extension having a spray tip mounted at the oppositive end. A paint roller system is mounted to the paint spray extension system by a mounting system which permits a commercially available off-the-shelf paint roller to be utilized with the system.

12 Claims, 6 Drawing Sheets

(56) References Cited

U.S. PATENT DOCUMENTS 3,109,755 A * 11/1963 Stanley ..... B05C 17/02 118/258
3,205,522 A * 9/1965 Then ..... A47J 45/02 15/146
3,331,093 A * 7/1967 Mayden ..... B05C 17/0207 401/190
3,354,493 A * 11/1967 Pharris ..... B05C 17/02 15/230.11
3,745,624 A * 7/1973 Newman ..... B05C 17/02 492/19
3,748,678 A * 7/1973 Ballou ..... A46B 11/063 15/24
3,893,630 A * 7/1975 Bochmann ..... A01M 7/0039 239/587.5
3,940,072 A * 2/1976 Ishikawa ..... B05B 15/652 239/525
4,059,358 A * 11/1977 Arai ..... B05B 1/267 401/219
4,683,610 A * 8/1987 Richards ..... B05C 17/0205 15/144.4
4,744,519 A * 5/1988 Crowley ..... B05B 15/628 239/532
5,050,261 A * 9/1991 Hofacker ..... B05C 17/022 15/144.1
5,207,755 A * 5/1993 Ampian ..... A46B 5/0075 15/144.1
5,230,303 A * 7/1993 Rubino ..... A01K 13/002 119/603
5,579,558 A * 12/1996 Newman, Jr. ..... B05C 17/0205 15/144.4
5,595,451 A * 1/1997 Harrison, Jr. ..... B05B 1/00 401/219
5,685,658 A 11/1997 Woodruff
5,966,847 A * 10/1999 Nathenson ..... B08B 5/02 137/874
6,254,017 B1 * 7/2001 Kuo ..... B05B 15/65 239/532
6,688,540 B1 * 2/2004 Passarella ..... A46B 11/063 239/280
D556,547 S * 12/2007 Lanz ..... D8/355
7,455,469 B1 * 11/2008 Langdon ..... B05C 17/03 401/136
8,821,058 B2 * 9/2014 Walker ..... B05C 17/003 401/219
9,140,398 B2 * 9/2015 Lang ..... F16L 55/1108
D764,257 S * 8/2016 Gastelum ..... A46B 5/0075 D8/355
9,789,506 B2 * 10/2017 Kosta ..... B05B 15/628
2002/0074138 A1 * 6/2002 Guard ..... A01B 1/00 172/21
2002/0104181 A1 * 8/2002 Woodruff ..... B05C 17/02 15/230.11
2003/0111556 A1 * 6/2003 Kuo ..... B05B 15/65 239/530
2007/0102535 A1 * 5/2007 Carey ..... B05B 15/534 239/74
2007/0122227 A1 * 5/2007 Davis ..... B05B 15/628 401/137
2008/0247808 A1 * 10/2008 Costigan ..... B05C 17/035 401/219
2010/0183362 A1 * 7/2010 Franklin ..... B05C 17/022 403/96
2013/0306761 A1 * 11/2013 Chen ..... B05B 1/267 239/569
2016/0325306 A1 * 11/2016 Johnson ..... B05C 17/0222

* cited by examiner

EXTENSION PAINT SPRAY-ROLLER SYSTEM

FIELD OF THE INVENTION

The present invention relates generally to a painting system, and more particularly to a painting system employing in combination a pole extension paint spray system together with a paint roller system.

BACKGROUND OF THE INVENTION

Painting professionals are in general very familiar with hydraulic or air-less spray painting as well as with painting utilizing a paint roller mounted on an L-shaped frame with a handle. In the hydraulic or air-less spray painting system, a spray tip is mounted at the distal end of a spray gun which controls the supply of high pressure paint to the spray tip whereby the high pressure paint exiting the spray tip is atomized suitable for spray painting purposes. For purposes of reaching elevated or difficult to reach surfaces for spray painting, a pole extension having an on-off control valve and handle at one end and a spray tip mounted at the opposite end is utilized. The pole extension consists of one or more extension elements depending on the length of the pole extension required. Similarly, for painting elevated or difficult to reach surfaces with a paint roller, an elongated pole extension is attached to the paint roller handle. For this purpose, handles of paint roller systems are internally threaded to accept the threaded ends of the elongated handles or extension poles. Such internally threaded paint roller handles are generally provided with a uniform diameter and thread size throughout the range of standard paint roller sizes, including 9, 12 and 18 inch wide rollers. However, some variation in handle thread size exists among different manufacturers.

Painting system manufacturers recognized the need among painting professionals for a painting system employing the benefit of speed of a spray paint system and the quality of the rolled finish of a paint roller system. One such combined painting system is the JetRoller System manufactured by Graco Inc. of Minneapolis, Minn., U.S.A. The Graco Inc. JetRoller System consists of a pole extension hydraulic paint spray system with at least one extension element which is adapted to accept a specially designed detachable paint roller system for use together with the hydraulic paint spray system. The hydraulic paint spray portion of the JetRoller System includes a specially adapted pole extension element having an on-off control valve and handle at one end connected via a high pressure hose to a source of high pressure paint and an air-less spray tip at the opposite end of the pole extension. The on-off control valve directs the high pressure paint through a channel in the pole extension to the spray tip, wherein the spray tip or nozzle causes the high Painting system manufacturers recognized the need among painting professionals for a painting system employing the benefit of speed of a spray paint system and the quality of the rolled finish of a paint roller system. One such combined painting system is the JetRoller System manufactured by Graco Inc. of Minneapolis, Minn., U.S.A. The Graco Inc. JetRoller System consists of a pole extension hydraulic paint spray system with at least one extension element which is adapted to accept a specially designed detachable paint roller system for use together with the hydraulic paint spray system. The hydraulic paint spray portion of the JetRoller System includes a specially adapted pole extension element having an on-off control valve and handle at one and connected via a high pressure hose to a source of high pressure paint and an air-less spray tip at the opposite end of the pole extension. The on-off control valve directs the high pressure paint through a channel in the pole extension to the spray tipl, wherein the spray tip or nozzle causes the high pressure paint to be atomized for spray painting. Additional pole extension elements may be interconnected between the on-off control valve/handle and the specially adapted pole extension element for greater pole length. The paint roller portion of the JetRoller System is uniquely designed although similar in structure to standard paint roller systems and includes a rotatable paint roller mounted on the forward arm of an L-shaped frame which has a cylindrically shaped handle disposed perpendicular to the axis of the paint roller mounted at the other or rear end of the frame. The handle includes an elongated hinged portion which allows the handle to be connected axially to the specially adapted pole extension so as to be releasably clamped thereon. The length of the paint roller frame is such that the rotatable roller is positioned forward of the spray tip which is rotatably mounted via a swivel joint at the forward end of the pole extension to rotate perpendicularly to the axis of the paint roller so that the paint spray issuing therefrom can be adjustably directed relative to the roller. The width of the paint spray pattern vis a vis the rotatable roller can be adjusted by loosening the paint roller handle thereby unclamping the handle and sliding it axially on the pole extension. Positioning the roller closer to the spray tip narrows the spray pattern and positioning it farther away from the spray tip widens the spray pattern. When desirable or necessary, the paint roller can be detached from the pole extension by unclamping the paint roller handle from the pole extension and using the paint roller system separately. Each paint roller size of the Graco JetRoller System, whether 9", 12", or 18", has its own specially designed frame and handle for use with the pole extension of the paint spray portion of the JetRoller System.

SUMMARY OF THE INVENTION

It is a primary object of the present invention to provide an extension paint spray-roller system which allows the hydraulic paint spray extension system portion thereof to be combined and utilized with substantially any commercially available off the shelf paint roller system of standard size including the 9", 12", and 18" paint roller systems.

The above object, as well as others which will hereinafter become apparent, is accomplished in accordance with the present invention by providing an extension paint spray-roller system with a mounting system adapted to connect the hydraulic paint spray extension system portion with substantially any commercially available paint roller system. The mounting system includes a transversely extending element adapted to rotate about and slide axially along the length of the pole extension to be clamped in any position therealong and an adapter element securable to a commercially available standard paint roller system and releasably attached to the transversely extending element so that the paint roller system is mounted substantially parallel to and spaced from the hydraulic paint spray extension system.

BRIEF DESCRIPTION OF THE DRAWINGS

The objects and features of the present invention will become apparent from the following detailed description when considered together with the accompanying drawings.

It is to be understood that the drawings are designed as an illustration only and not as a definition of the limits of the present invention.

In the drawings wherein similar reference characters demote similar elements throughout the several views:

FIG. 1 is a perspective view of the extension paint spray-roller system according to the present invention;

FIG. 2 is an exploded view of the extension paint spray-roller system shown in FIG. 1;

FIG. 3 is a top view of the extension paint spray-roller system of the present invention;

FIG. 4 is a bottom view of the extension paint spray-roller system of the present invention;

FIG. 5 is a cross sectional view of the extension paint spray-roller system taken along line 5-5 of FIG. 3;

FIG. 6 is a side elevational view of the extension paint spray-roller system of the present invention in a first condition of use; and FIG. 7 is a perspective view of the extension paint spray-roller system of the present invention shown in a second condition of use.

DETAILED DESCRIPTION OF THE INVENTION

Figure 1:
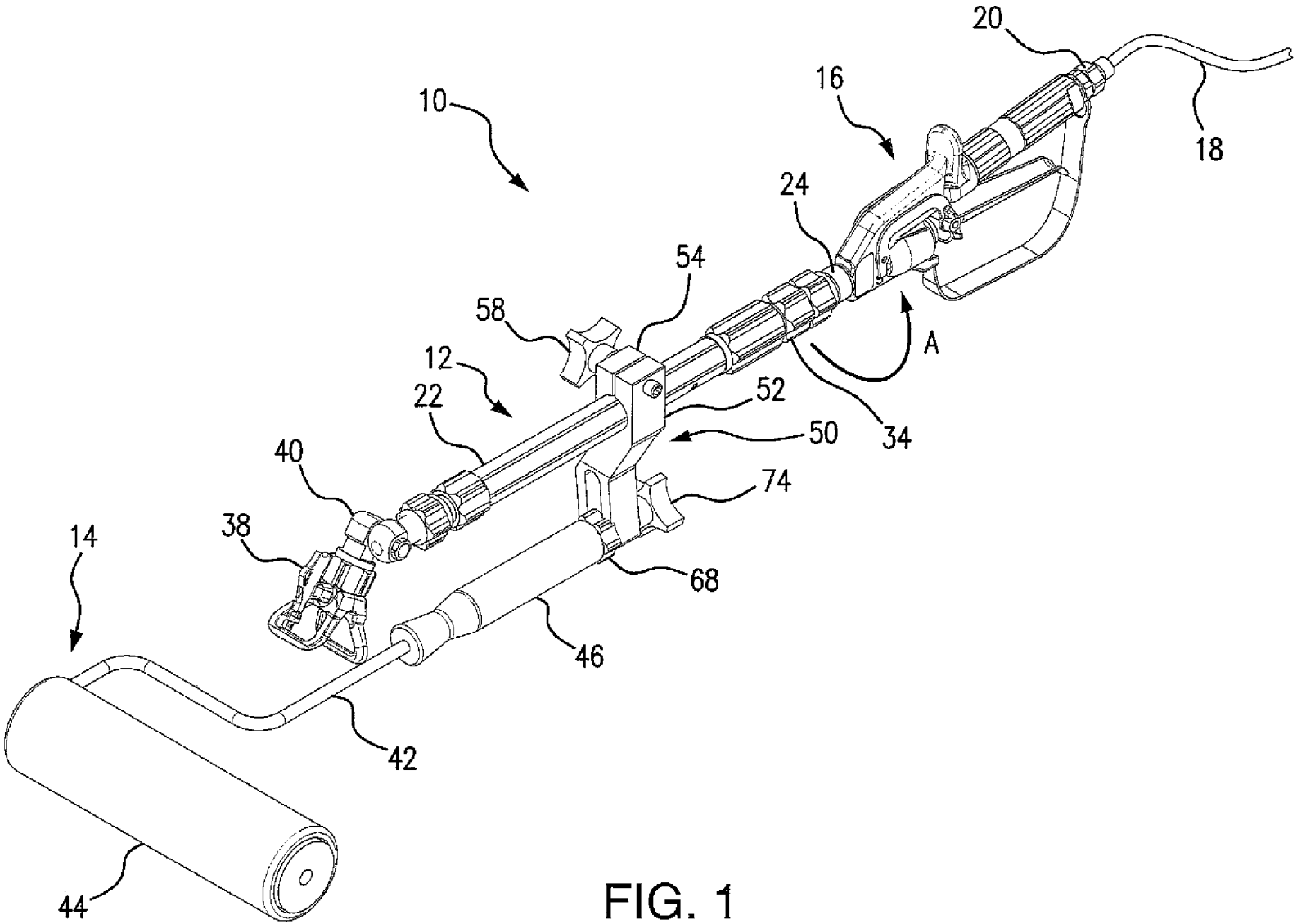
Figure 2:
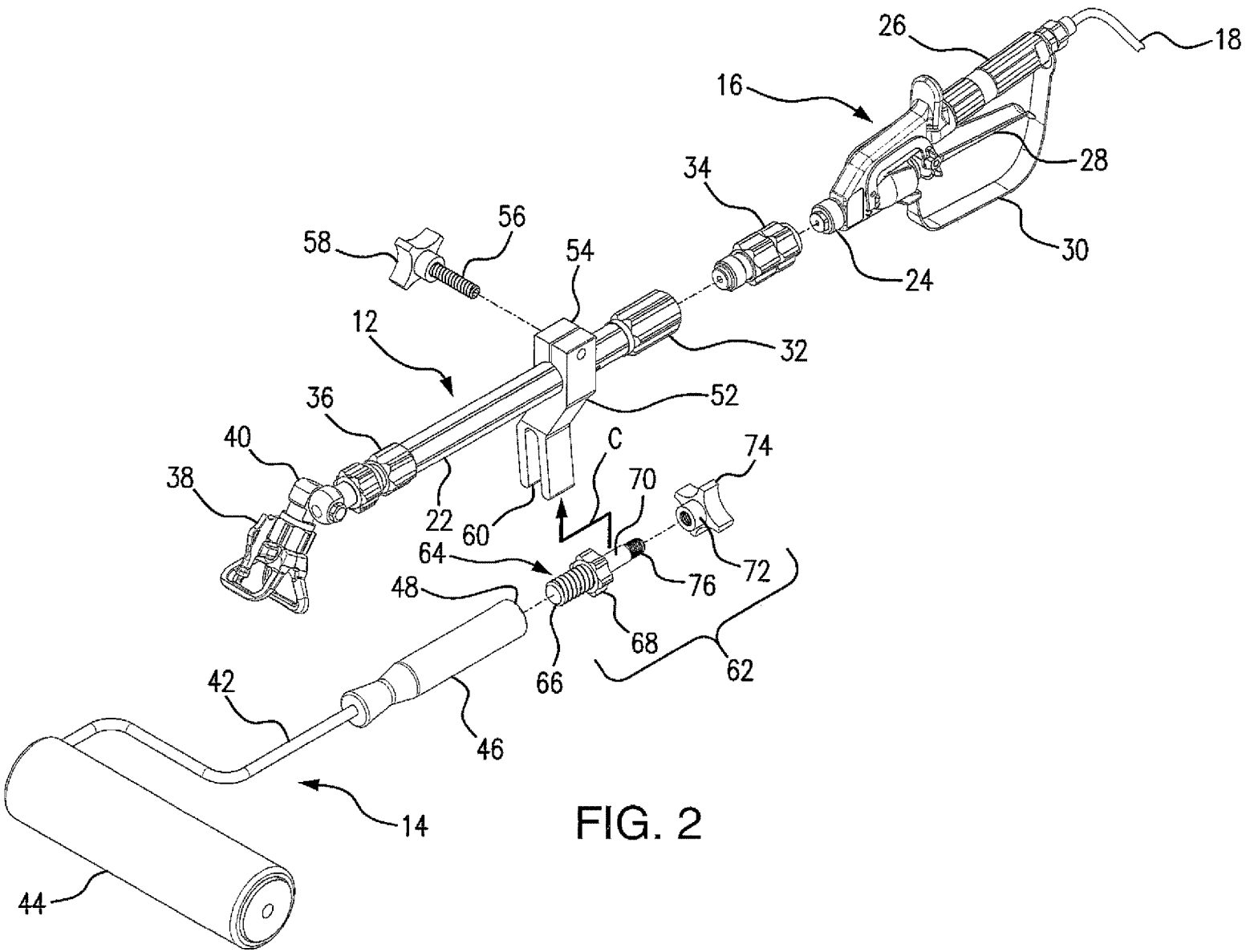

Turning now to the drawings, there is shown in FIGS. 1 and 2 an extension paint spray-roller system, generally designated 10, including a hydraulic paint spray extension system portion, designated 12, and a paint roller system portion, designated 14. The hydraulic paint spray extension system portion 12 includes an on-off control valve/handle 16 connected via a high pressure hose 18 to a source of high pressure paint at a first end 20 and to a pole extension 22 of the paint spray system portion 12 at a second end 24. On-off control valve/handle 16 includes a handle 26, a trigger 28 for controlling the on/off control valve and a trigger/hand guard 30.

The pole extension 22 of hydraulic paint spray extension system portion 12 is provided with a longitudinally extending through bore for transmitting the high pressure paint and is connected at a first end 32 to end 24 of on-off control valve/handle 16 via in-line straight through swivel joint or union 34. On-off control valve/handle 16 is arranged relative to pole extension 22 so that handle 26 is substantially aligned with the pole extension for ease of handling and, because of swivel joint 34, on-off control valve/handle 16 is adapted to rotate 360° axially about pole extension 22 as indicated by direction arrow A in FIG. 1. At the second or distal end 36 of pole extension 22 a hydraulic or air-less spray tip with tip guard, designated 38, is attached to the pole extension via a 90° swivel joint or union, designated 40, allowing the spray tip to be rotated transversely relative to the axis of pole extension 22 as shown by direction arrow B in FIG. 6. One or more additional pole extensions may be added to the system depending on the length of the system desired.

Paint roller system portion 14 includes an L-shaped frame, designated 42, having a paint roller 44 rotatably mounted to a transverse arm at the forward end of frame 42 perpendicular to a handle 46 mounted at the other or rear end of frame 42. The distal end 48 of handle 46 of paint roller system portion 14 is internally threaded with a standard thread size and internal diameter so as to accept a standard paint roller pole extension.

A mounting system, designated 50, includes a mounting block 52 attached to pole extension 22 for axial sliding movement thereon and rotation thereabout. Mounting block 52 is provided at its end attached to pole extension 22 with a split-ring type compression clamp 54 which, when tightened by clamp screw 56, positionally secures mounting block 52 to pole extension 22. A knob-like handle 58 is provided for turning clamp screw 56 for conveniently tightening and loosening clamp 54 by hand. Mounting block 52 can be axially repositioned on pole extension 22 as well as rotationally repositioned thereon simply by loosening clamp 54 and adjusting the position of mounting block 52 as desired or needed. Mounting block 52 extends transversely from pole extension 22 and is bifurcated at its end remote from compression clamp 54 forming an open ended slot 60 directionally aligned with pole extension 22. A paint roller system adaptor, designated 62, includes an elongated rod-like element 64 threaded at end 66 for threaded engagement with the internal threads of end 48 of handle 46 of paint roller system portion 14. Opposing threaded end 66 and separated therefrom by bearing surface 68 is a rod-like bearing shaft 70 adapted to be received in slot 60 of mounting block 52 as indicated by direction arrow C in FIG. 2. Adaptor 62 further includes a compression nut 72 having a knob-like operating handle 74. Compression nut 72 is adapted to engage with the threaded end 76 of rod-like element 64 extending from bearing shaft 70 to compress the bifurcated end of mounting block 52 between compression nut 72 and bearing surface 68 and secure adaptor element 64 in slot 60 of mounting block 52. As can clearly be seen in the drawings, mounting system 50 allows paint roller system portion 14 to be mounted in the same plane as pole extension 22 of paint spray extension system portion 12 and substantially parallel to and spaced from pole extension 22.

Figure 3:
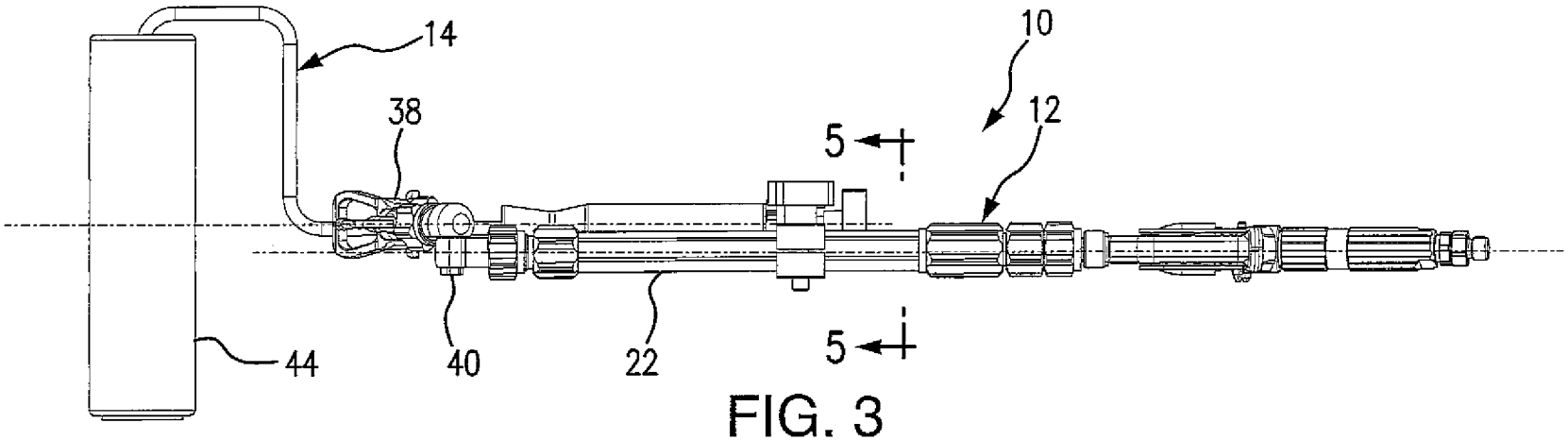
Figure 4:
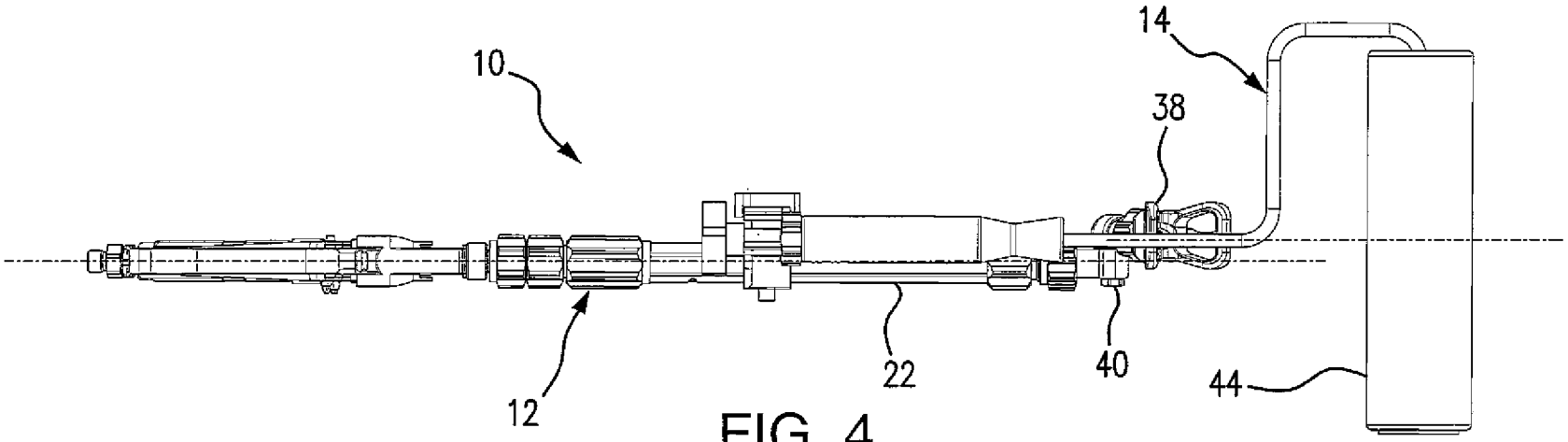
Figure 5:
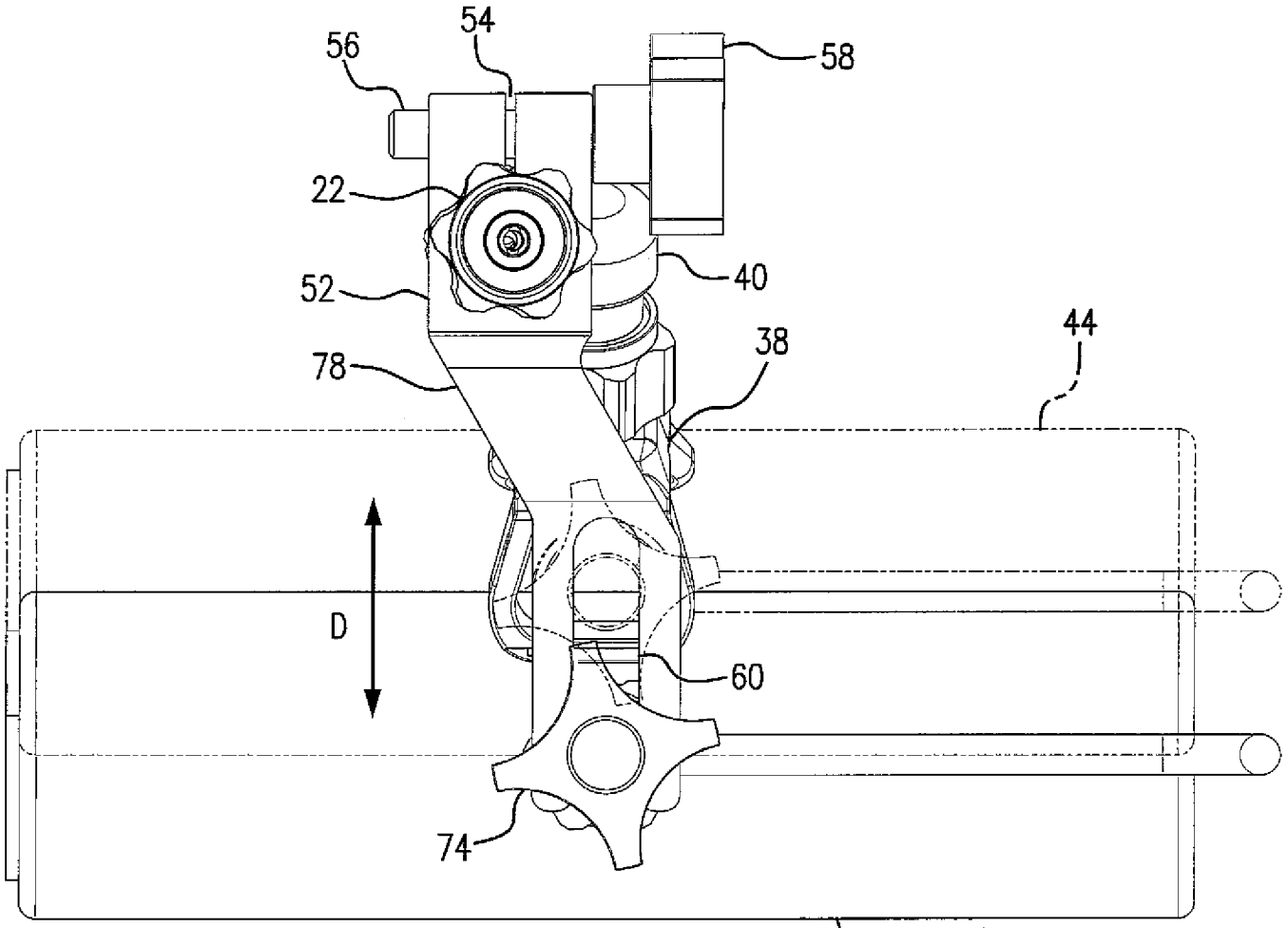

FIGS. 3 and 4 are top and bottom views, respectively, of the extension paint spray-roller system 10 and clearly show that the center of spray tip 38 is off-set from the center line or axis of pole extension 22 of paint spray extension system portion 12 as a result of the off-set of 90° swivel joint 40. Thus, in order for the spray pattern issuing from spray tip 38 to be centered with respect to roller 44, paint roller system portion 14 must be off-set an amount equal to the off-set of 90° swivel joint 40. In order to accomplish this off-set, the transversely extending portion of mounting block 52 including slot 60 is off-set at 78 from the axis of pole extension 22 to the same side thereof as 90° swivel joint 40, as clearly seen in FIG. 5. Slot 60 at the distal end of mounting block 52 allows the position of paint roller system portion 14, as shown by direction arrow D, to be adjusted closer to or farther from pole extension 22 so as to adjust the balance of the extension paint spray-roller system 10 to suit the user thereof.

Figure 6:
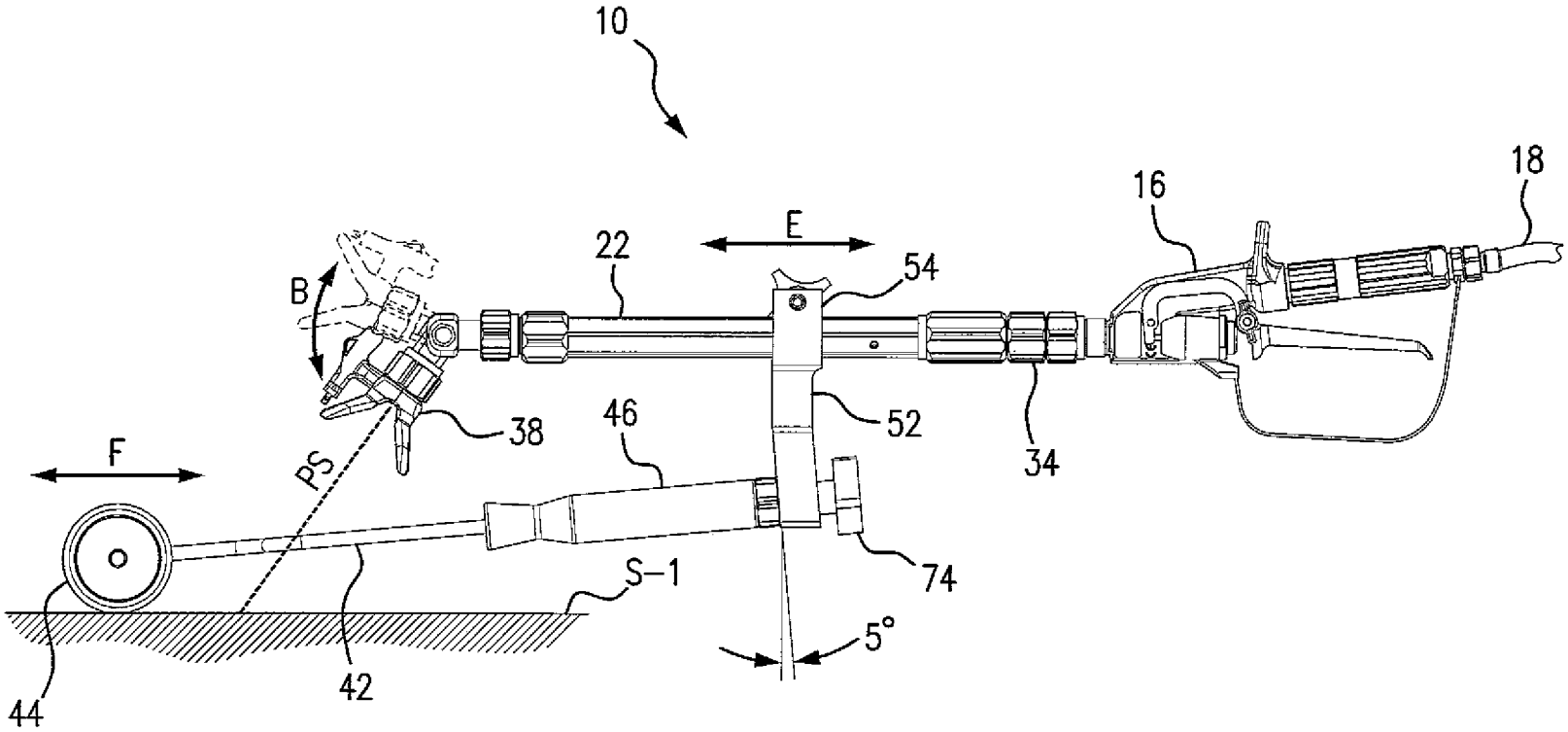

FIG. 6 shows the extension paint spray-roller system 10 in operation paint spraying and back-rolling a surface S-1. As clearly shown, for best painting results the paint spray PS issuing from spray tip 38 is preferably directed near the base of roller 44 of paint roller system portion 14 and the fresh paint is then back-rolled using roller 44. Also as clearly shown in FIG. 6, paint roller system portion 14 is preferably angled slightly away from the axis of pole extension 22 so that the paint roller 44 is positioned slightly farther away from spray tip 38 during use so as to prevent interference with the paint spray issuing from the spray tip. To provide the angulation of paint roller system 14 relative to pole extension 22, the end of mounting block 52 to which paint roller system 14 is attached is angled at about 5° from a perpendicular line extending from pole extension 22. Also as shown in FIG. 6, mounting block 52 can be axially moved and repositioned on pole extension 22, as indicated by direction arrow E, by the loosening of clamp 54 of mounting system 50. The repositioning of mounting block 52 repositions roller 44 on surface S-1 relative to spray tip 38 as indicated by direction arrow F and the rotational position of paint spray PS can be adjusted vis a vis roller 44 by rotating spray tip 38 according to direction arrow B. In this manner the position of the paint spray PS issuing from spray tip 38 can be directed to the front of, to the rear of, or directly onto roller 44 as needed or desired.

Figure 7:
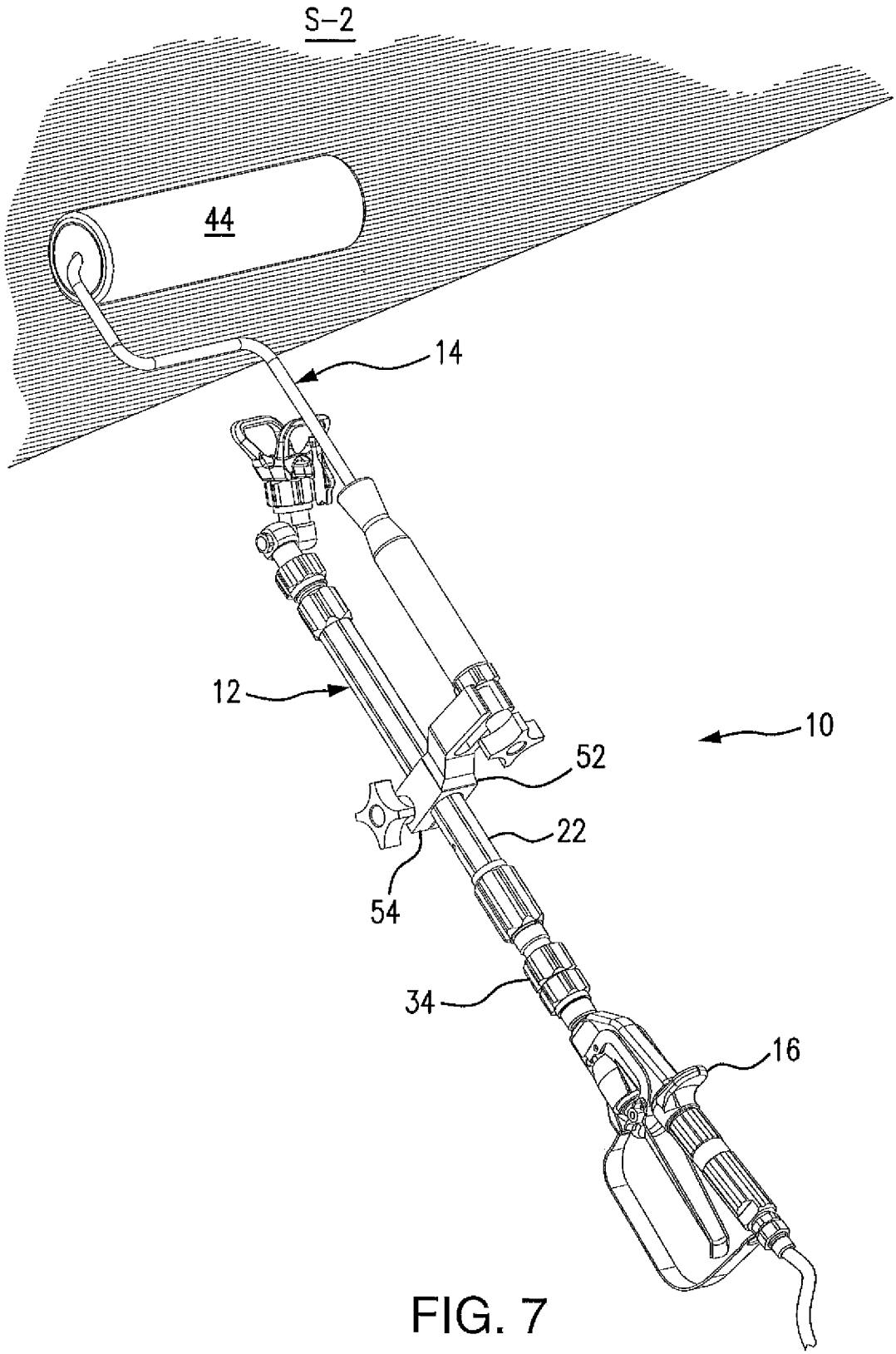

In FIG. 7 the extension paint spray-roller system 10 is shown in operation painting a surface S-2, which may be a ceiling or other elevated surface. As clearly seen, the paint roller system portion 14 of system 10 is positioned above paint spray extension system portion 12. This positioning of the paint roller system relative to the pole extension system can be accomplished by loosening the clamp 54 of mounting block 52 and rotating the block relative to pole extension 22 or by rotating on-off control valve/handle 16 through swivel joint 34 about pole extension 22.

As pointed out above, paint roller system 14 can be disconnected from extension paint spray-roller system 10 and used solely as any paint roller simply by loosening compression nut 72 of paint roller system adaptor 62 and disengaging adaptor 62 from slot 60 of mounting block 52 of mounting system 50. During the separate use of paint roller system 14, paint roller system adaptor 62 can remain connected to handle 46 of the paint roller. In order to accommodate the various thread sizes of the internally threaded handles provided by the different manufacturers of the standard paint roller systems, it is contemplated that several adaptors 62 having different sized threaded ends 64 would be made available.

While only a single embodiment of the present invention has been shown and described, it will be understood that many changes and modifications may be made thereto without departing from the spirit and scope of the invention.

The invention claimed is:

1. An extension paint spray-roller system, comprising:

a) a paint spray extension system portion including an elongated pole extension having a longitudinally extending through bore, an on-off control valve/handle communicating with a source of high pressure paint and operatively connected to a first end of said pole extension, an air-less spray tip disposed at a second end of said pole extension operatively communicating via a 90° swivel joint and the pole extension through bore with said on-off control valve/handle, said spray tip adapted to issue a paint spray pattern transverse to a longitudinal axis of said pole extension;

b) a paint roller system portion including an L-shaped paint roller frame, a paint roller rotatably mounted on a forward transverse leg of said frame at a first end thereof perpendicular to a paint roller handle arranged at a second end thereof, said handle having at a distal end thereof an internally threaded bore; and c) a mounting system for mounting said paint roller system portion to said paint spray extension system portion so that said system portions are usable in conjunction with one another, wherein said paint roller system portion is arranged in the same plane as and spaced from the pole extension of said paint spray extension system portion so that said paint roller is disposed transverse to a longitudinal axis of said pole extension, said mounting system including a transversely extending mounting block connected at a first end for axial and rotational movement on said pole extension and having a clamp for releasably clamping said mounting block in position on said pole extension, a rod shaped adaptor threaded at a first end for threaded engagement with the internally threaded handle of said paint roller system portion and having a clamp at a second end for releasably clamping said adaptor to a second end of said transversely extending mounting block.

2. The extension paint spray roller system as defined in claim 1, wherein said transversely extending mounting block of said mounting system is connected at a first end on said pole extension by a split-ring compression clamp securable by a clamp screw provided with an operating handle.

3. The extension paint spray-roller system as defined in claim 1, wherein said 90° swivel joint connecting said air-less spray tip to the second end of said pole extension off-sets said spray tip from the longitudinal axis of said pole extension and wherein the second end of said transversely extending mounting block is off-set from the longitudinal axis of said pole extension an equal amount as said spray tip so as to align said spray tip with a center of an axis of said paint roller.

4. The extension paint spray-roller system as defined in claim 3, which further includes an in-line straight through swivel joint connecting said on-off control valve/handle to the first end of said pole extension so as to permit rotation of said on-off control valve/handle relative to the longitudinal axis of said pole extension.

5. The extension point spray-roller system as defined in claim 4, wherein said in-line straight through swivel joint connecting said on-off control valve/handle to the first end of said pole extension permits 360° rotation of said on-off control valve/handle relative to the longitudinal axis of said pole extension.

6. The extension paint spray-roller system as defined in claim 1, which further includes an in-line straight through swivel joint connecting said on-off control valve/handle to the first end of said pole extension so as to permit rotation of said on-off control valve/handle relative to the longitudinal axis of said pole extension.

7. The extension paint spray-roller system as defined in claim 6, wherein said in-line straight through swivel joint connecting said on-off control valve/handle to the first end of said pole extension permits 360° rotation of said on-off control valve/handle relative to the longitudinal axis of said pole extension.

8. The extension paint spray-roller system as defined in claim 6, wherein the second end of said transversely extending mounting block is bifurcated to form an open ended slot directionally aligned with the longitudinal axis of said pole extension and adapted to receive therein a shaft portion of said rod shaped adaptor to be clamped in position in said slot by said adaptor clamp.

9. The extension paint spray roller system as defined in claim 8, wherein the second end of said adaptor includes a threaded extension extending from said adaptor shaft portion and said adaptor clamp comprises a compression nut having an operating handle and engageable with said threaded extension so as to compress the bifurcated end of said mounting block between said compression nut and a bearing surface of said adaptor.

10. The extension paint spray-roller system as defined in claim 6, wherein said paint roller system portion is mounted to said paint spray extension system portion so as to be disposed in the plane defined by the pole extension of said paint spray extension system portion and said paint roller system portion at an angle with respect to said pole extension so that said paint roller is disposed farther from said spray tip so as to avoid interference with the paint spray issuing therefrom.

11. The extension paint spray-roller system as defined in claim 10, wherein the second end of said mounting block to which said adaptor is releasably clamped is angled 5° from a perpendicular line from said pole extension so as to dispose said paint roller system portion at a 5° angle with respect to said paint spray extension system portion pole extension.

12. The extension paint spray-roller system as defined in claim 10, wherein the angle defined between said paint roller system portion and said paint spray extension system portion pole extension is 5°.

* * * * *